US010627193B1

(12) United States Patent
Meyers et al.

(10) Patent No.: US 10,627,193 B1
(45) Date of Patent: Apr. 21, 2020

(54) ARMOR FOR LIGHTWEIGHT BALLISTIC PROTECTION

(75) Inventors: John J. Meyers, Penfield, NY (US); Cornelius J. Gearin, Pittsford, NY (US); William I. Elrod, Jr., Rochester, NY (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 07/315,961

(22) Filed: Feb. 27, 1989

(51) Int. Cl.
*F41H 5/04* (2006.01)

(52) U.S. Cl.
CPC ..... *F41H 5/0435* (2013.01)

(58) Field of Classification Search
USPC ..... 89/36.02; 428/911; 2/2.5
See application file for complete search history.

(56) References Cited

U.S. PATENT DOCUMENTS

| | | | | | |
|---|---|---|---|---|---|
| 3,671,374 | A | * | 6/1972 | Kolarik | 428/911 |
| 3,804,034 | A | * | 4/1974 | Stiglich | 428/911 |
| 4,030,427 | A | * | 6/1977 | Goldstein | 89/36.02 |
| 4,061,815 | A | * | 12/1977 | Poole | 428/911 |
| 4,198,454 | A | * | 4/1980 | Norton | 428/911 |
| 4,879,165 | A | * | 11/1989 | Smith | 89/36.02 |

OTHER PUBLICATIONS

Appl. Sci. Technol. vol. 5, 1980 "Ceramic Composite Armor", Laible.*

Rudoi, U.S. Pat. No. 4,633,756, Jan. 1987 shows overlapping ceramic plates in pockets.

Parcher et al., U.S. Pat. No. 4,645,720, Feb. 1987 shows multi layers of metal of different hardness in an armor plate.

Bottini et al., U.S. Pat. No. 4,200,677, Apr. 1980 describes Kevlar as bullet-proof material.

(Continued)

*Primary Examiner* — Michael D David
(74) *Attorney, Agent, or Firm* — James A. Smith

(57) ABSTRACT

Armor for lightweight ballistic protection is made up of composite tiles which can be assembled into modules. The modules can be assembled into panels and can be mounted on vehicles and aircraft and on the walls of shelters. The tiles have core layer(s) of non-homogeneous materials provided by particles of grit distributed in a plastic, preferably rigid polymeric matrix, and which are faced by a layer of high modulus stiff material such as ceramic. The tiles are preferrably backed by elastomeric material and may have sheets of composite material between the elastomeric layer and the non-homogenous core layer. The tiles may be stacked, forming modules and the modules assembled in rows to form panels. An incoming object causes the facing layer to distribute the impact force over a large area of the non-homogeneous grit/polymeric core layer which fractures and absorbs the impact and shock waves, both the compressive direct wave and the tensile wave reflected from the back interface. The non-homogenity and distributed grit particles in the core layer also serve to reflect and disperse the shock wave. The elastomeric layer also aids in distributing the shock wave. In response to the impact and shock waves and projectile penetration, the non-homogeneous grit/polymeric core layer cracks, pulverizes and disintegrates resulting in high energy absorption by crack propagation. Also the small debris particles which are generated absorb kinetic energy as they are propelled into motion, diverted and scattered.

52 Claims, 3 Drawing Sheets

(56) References Cited

OTHER PUBLICATIONS

Medlin, U.S. Pat. No. 4,352,316, Oct. 1982 shows laminations of plastics on panels to armor plate a car.
Lancaster et al., U.S. Pat. No. 4,678,702, Jul. 1987 shows Kevlar and plastic laminate as bullet protection material.
Dunbavand, U.S. Pat. No. 4,608,717, Sep. 1986 shows a bullet-proof vest with a Kevlar layer over a bag of foam or the like.
Ratner et al., U.S. Pat. No. 4,741,241, May 1988 shows reactive, explosive armor modules.
Davis, U.S. Pat. No. 3,894,472, Jul. 1975 shows offset plates on a flexible sheet to provide a bullet-proof armor.
Grillo, U.S. Pat. No. 4,738,893, Apr. 1988 describes ceramic on packing material and steel/plastic (Kevlar) laminations.
Snedeker, U.S. Pat. No. 4,683,800, Aug. 1987 shows ceramic blocks in pockets in criss cross layers of metal.
Schijve et al., U.S. Pat. No. 4,500,589, Feb. 1985 shows aramid high tensile reinforcement in a plastic laminate between metal sheets.
Chyung et al., U.S. Pat. No. 4,719,151, Jan. 1988 shows facing of ceramic on a backing of fiberglass.
Rudoi, U.S. Pat. No. 4,473,653, Sep. 1984 shows glass with ceramic additive on a flexible steel plate or mesh.
Moskowitz, U.S. Pat. No. 4,739,690, Arp. 1988 shows spall shield of plastic material on ceramic layer over a Kevlar layer.
Schwetz et al., U.S. Pat. No. 4,524,138, Jun. 18, 1985 shows silicon carbide plates but not specifically for armor.
Griesbach, U.S. Pat. No. 3,952,365, Apr. 27, 1976 and Lundberg et al., U.S. Pat. No. 4,497,923, Feb. 5, 1985 show rheopectic materials.

* cited by examiner

ARMOR FOR LIGHTWEIGHT BALLISTIC PROTECTION

INTRODUCTION

The present invention relates to improved armor structures, and particularly to improved armor structures which can be provided in the form of composite tile, modules containing a plurality of tiles and panels containing assemblies of tiles and/or modules.

The present invention is especially suitable for use in providing lightweight ballistic protection against incoming objects which present threats of harm and damage to persons and property. The term ballistic should be taken not only to mean that the objects presenting the threat originate in firearms such as rifles, pistols and artillery pieces but also fragments of bombs, grenades, or from explosions. In the form described herein, the invention is especially adapted to handle projectile threats from such lightweight projectiles as bullets, whether from rifles or machine guns, shrapnel and other fragmentary objects. Heavier weight projectiles such as rocket propelled projectiles, explosive artillery shells and bombs may also be handled by suitably configuring the modules and panels provided in accordance with the invention. The invention may be used to provide protective wall structures to shield shelters for personnel, aircraft and other equipment. Armor tiles, tile modules and panels, embodying the invention may also be mounted on vehicles (cars, trucks and tanks), on aircraft such as helicopters on boats and ships, and around equipment so as to provide effective ballistic protection against penetration from incoming objects or spall resulting from such objects. Tiles provided by the invention may also be assembled in a vest or other garment to provide ballistic protection for personnel.

BACKGROUND

Armor protection is usually provided by steel or other homogenous material plates which retard and hopefully prevent the penetration of incoming missiles, primarily by material shear strength and strain energy to failure. Even if penetration is prevented, plasmas and shock waves resulting from the missile can cause break up, usually tensile failure, of the inside wall of the plate. This results in the armor plate itself creating missiles, known as spall, which can injure personnel and damage equipment. The armor may be in the form of several plates in series which can move and chop the projectile or the plasma jet created by the projectile, thereby diverting the projectile. Such plates slide as they are penetrated and are referred to as Chobham armor. Spall nevertheless can result upon impact of the Chobham armor. The homogeneous nature of the armor, whether as individual slabs or slidable plates, provides a good conductor of shock waves which is the major contributor for the spall. Reactive armor has been suggested which explodes on impact. The explosion opposes the incoming shock wave and penetrator, causing their diversion. So called explosive or reactive armor even if modularized can explode in unison causing even more severe damage to the vehicle on which the reactive armor is mounted than the incoming threat. Also, the replacement of the reactive armor modules is difficult.

In order to provide complete ballistic protection against high kinetic energy threats, even in the case of lightweight ballistics (excluding hyper velocity threats or shaped charges) requires a heavy armor, when steel or steel plates are used. Even armor using ceramic or plastics, such as Kevlar[(1)] (aramid fibers) does not provide complete lightweight ballistic protection. Lightweight ballistics which must be completely stopped and can be stopped in accordance with the invention are typified by the following data:

Type I—Material-Tungsten; velocity 4920 ft/sec; shape-sphere; diameter 0.63 inch; weight 40 grams; and kinetic energy (KE)=33117 ft-lb.

Type II—material-tungsten; velocity 2600 ft/sec; shape cylindrical (L/D=4) (where L is the length of the cylinder and D is its diameter); diameter 0.33 inches; weight 25.4 grams; and KE 5873 ft-lb. Calculations and tests indicate that to be effective in providing complete lightweight ballistic protection to these threats the foregoing steel plate-type armor would weigh at least 140 pounds per square foot of frontal area. It will be apparent that such protection would add an impractical weight burden in the case of aircraft, and would add such a load that it would be practical only for powerful vehicles such as tanks and half-tracks or on large ships. Aircraft so protected could not become airborne. For example, helicopters cannot be so overloaded and be operable. Revetments and walls would also be so heavy as to preclude their practical portability. Shelters so protected could not be portable but would necessarily be permanent installations which would not meet tactical objectives. Accordingly, the problem remains to provide effective ballistic protection without the severe weight penalty imposed by conventional armor. It is also desirable to provide complete protection without the dangers incident to the use of reactive, explosive armor.

(1) Dupont Trade Name

It has been calculated that an armor structure, embodying the invention, providing complete ballistic protection equivalent to steel armor having an estimated weight of 140 pounds per square frontal foot would weigh only 49 pounds per square frontal foot. The weight would be less when threats having less energy than those listed above are to be protected against. For less kinetic energy bullets or ballistic fragments, an area density of about 9.77 pounds per square frontal foot can be achieved with armor structures embodying the invention. This is based upon employing only one 3"×3"×¾" thick tile element such as shown in FIG. 1 oriented obliquely (e.g. 45 degrees) to the incoming threat. With modules all layed-up at 0° facing toward the threat field the weight would be only 8.63 pounds per square foot of frontal area because fewer tiles are needed to span the area to be protected. Also, for many threats even thinner tiles (less than ¾") will be needed which will further reduce the necessary weight. Accordingly, ballistic protection of the type provided by bullet proof vests can be provided utilizing the invention. Also, semi-permanent or quickly and easily positionable walls of revetments and shelters (for example, for the protection of aircraft) may be provided in accordance with the invention.

An additional problem is presented by the environment. Temperature extremes, moisture and wind, in addition to many chemicals such as solvents, acid, alkalize, fuels, hydraulic fluids and salt spray must be tolerated. Armor structures provided in accordance with the invention, unlike steel and other chemically sensitive materials, are adapted to handle and be operative for long periods of time under severe environmental conditions such as noted above.

SUMMARY OF THE INVENTION

Accordingly, it is a principal object of the present invention to provide improved armor structures.

It is a further object of the invention to provide improved armor structures which are lighter than most conventional armor, such as steel plates, while providing effective ballistic protection against penetration and spall.

It is a still further object of the present invention to provide improved armor structures which may be used as a protective wall structure for shelters and revetments and is portable so that the protective wall structure can be easily set up, repositioned or relocated.

It is a still further object of the present invention to provide improved armor structure which is modular and individual modules of which can be replaced so as to restore the structure after protecting against a threat which results in the destruction or damage to individual modules.

Briefly described, armor structure in accordance with the invention, which protects against incoming objects, is made up of elements which are referred to hereinafter as tiles having at least a first body and a second body. The first body is of non-homogeneous material which is frangible upon impact. Preferably the material of the first body is provided by particulate material distributed in a matrix of plastic. The second body is also of impact frangible material which is stiffer than the first body and is disposed adjacent the first body facing the incoming threat. The second body distributes impacts from the incoming objects and may crack and fracture and in the process absorbing some of the impact energy. The impact energy is distributed over a broad area of the second body which absorbs and diverts the incoming objects and commutates its energy and the energy of the shock waves resulting from the object by fracturing pulverization and disintegration. The small particles resulting from such disintegration scatter and because of their small mass have insufficient individual energy to penetrate the tile support sheets to cause harm to equipment or personnel in the protected area behind the structure. Nevertheless, the integrated total kinetic energy transferred to these individual particles is an important contribution to the energy absorbed in stopping the penetrating projectile. The tiles may be assembled into modules containing a stack of tiles and the modules may be assembled into panels. Individual tiles may be used as protective elements in a panel, for example in a garment such as a bullet proof vest. The modules are desirably oriented with modules in different rows at different angles which may be oblique to the direction of the incoming objects. When a tile or module is destroyed by an incoming object it can easily be replaced to restore the armor structure. A catcher shield can be used also to support the tile modules and serves the purpose to contain and control small flying particles. A current preferred embodiment has employed both elastomers and fibers of high strain energy for the catcher shield.

The foregoing and other objects, features and advantages of the invention as well as presently preferred embodiments thereof will become more apparent from a reading of the following description in connection with the accompanying drawings.

DETAILED DESCRIPTION

Figure 1:
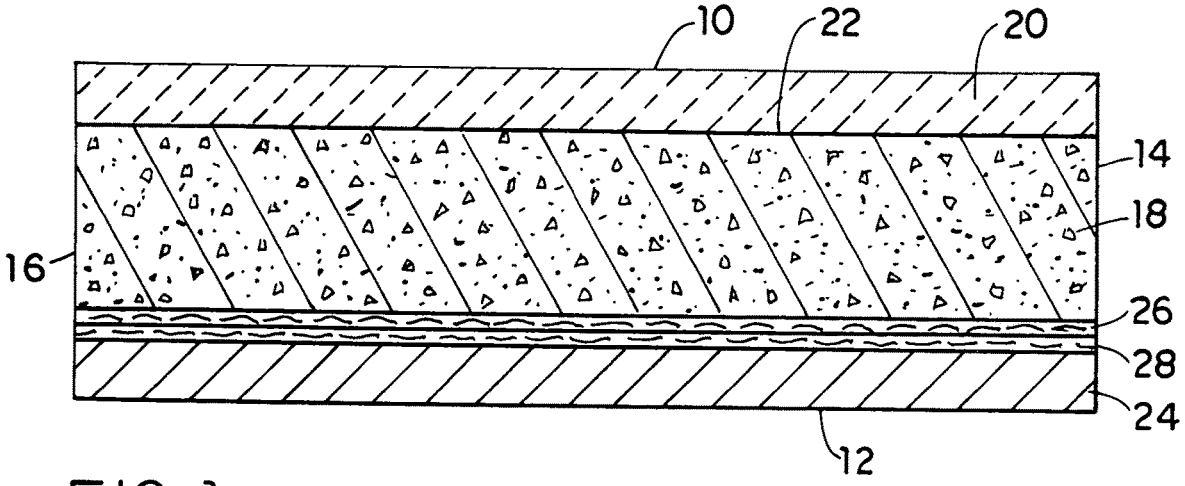
FIG. 1 is a sectional view through a rectilinear (for example, square in plan view) tile which is provided in accordance with the invention.

Referring to FIG. 1 there is shown a section through a tile which is a rectangular prism. The opposite sides 10 and 12 of the tile may be square and in a presently preferred form are three inches in length and width. The sides 14 and 16 of the tile provide its thickness, which in a presently preferred form is ¾ of an inch. These dimensions may be varied in accordance with the threat to be protected against. For example, it may be desirable to provide modules as shown in FIGS. 3, 5, 6 and 7 which are cubes. Such modules may be made up of a stack of four tiles. Alternatively, the tiles may be 1½ inches in thickness. Then only two tiles are used in each module. Likewise, thinner than ¾" tiles can be employed resulting in thinner (non-cubical) modules.

The tiles effectiveness in providing lightweight ballistic protection arises from the combination of two principal bodies which provide the core 18 and the facing 20 of the tile. These bodies are in effect layers of the tile. The core and facing are both of frangible material. The stiffness of the facing 20 is greater than the stiffness of the core. The facing 20 which is presently preferred is hot pressed or sintered/fired silicon carbide which is a ceramic material. Other ceramic materials which have high stiffness modulus may also be used. The facing is adjacent to the surface 22 of the core 18 which faces in the direction of the threat (the incoming objects). Because of its greater stiffness the facing distributes the impact force over the surface 22. Because the core is of frangible material which is both non-homogeneous and contains sites for stress risers to develop at each grit particle, there occurs cracking and indeed pulverization and disintegration of the core into millions of pieces (small sand-like particles when a high velocity object is incident on the facing 10).

The core has a high population of particles, preferably ceramic or quartz grit distributed throughout in a matrix of plastic. The plastic in a preferred embodiment is a brittle polymer, specifically an epoxy polymer. The grit is either ceramic or quartz particles. The particles are preferably of a size range from twenty to twenty-four grit maximum with low percentages of smaller particles and larger particles in the population passed through the sieve or other sizing mechanism. Grit is a size measure in accordance with standards promulated by ASTM. Both cubic and flake-form grit, can be employed. It is presently believed that the cubic shape is more effective for energy absorption than the flake shape. The flakes or cubes are desirably no larger than about 30 mils on their largest side.

In the event ceramic is used, crushed silicon carbide is presently preferable. Quartz (sand) may be found preferable in some cases because of its lower cost than ceramic particles.

The ceramic particles may be porous. For example, the ceramic which is used to provide the particles may be compressed sintered material where the compression and sintering allows for the formation of microscopic pores. It has been found that the air in such pores is advantageous in reflecting and distributing shock waves caused by the impact of incoming objects and enhances the cracking and pulverization process.

Because of its non-homogeneous nature, but mainly due to discontinuities introduced by the grit particles, the impact and shock waves create stress risers at each grit particle which causes the core to crack up and allow the cracks to propagate. This is a powerful energy absorption mechanism. Moreover, the particles prevent the shock waves from propagating as a uniform wavefront and in effect reflect the shock wave and block some of the energy. The cracking and particles cause propagation of the wave to be scattered in all directions thereby further spreading impact load and enhancing cracking. Moreover, the disintegration of the core into millions of particles even in the case of elastic collision results in a scattering of low mass particles. These particles have total integrated absorbed kinetic energy which is a significant fraction of the initial projectile energy but for an individual particle the energy is insufficient to penetrate the tile catcher-wall support sheets (70—FIGS. 5, 6 & 7). Thus, the debris causes no damage to the persons and property in the protected area behind the tile, tile module or panel of modules. The cracking and disintegration also precludes the generation of spall into the space beyond a panel of modules.

The core contains a much larger grit component than polymetric component. The grit component in a preferred embodiment makes up 80% of the core by weight. The weight percent range may suitably be from 60-90%.

A tile which is ¾ of an inch in thickness, the facing 20 may be ⅛ inch thick while the core is approximately ½ inch thick.

In fabricating the core, two parts by weight epoxy resin are mixed with one part by weight of hardener. The epoxy resin may, for example be epon 828 resin and the hardener yutak which are available from the Cumming Company. Another suitable resin is Hysol resin type RE203 with Hysol type HD3561 hardener. Hysol is obtainable from the Hysol Division of the Dexter Corporation, 15051 East Don Julian Road, Industry, California 91749 USA. Eighty percent by total weight of crushed quartz or silicon carbide grit is mixed with the resin so that the grit particles are uniformally distributed. The mixture is placed in a mold to define the rectangular prism shape of the core 18. The mold and mixture is set up for two hours at 150° F. After setting up the core is a solid body and is removed from the mold. A post-mold cure is accomplished by returning the body to the oven and allowing it to bake for 16-20 hours at 150° F.

The resulting core and equivalent cores which may be used in the tile have a low modulus of elasticity and a high toughness. The modulus of elasticity (E) of the core may be from 10,000 to 20,000 psi. This is orders of magnitude lower than the modulus of elasticity of the grit particles. It is also desirable that the core have a high toughness. A toughness (K) of 20,000 psi (inches)$^{1/2}$ is suitable. Because of its high toughness and low modulus the energy absorption per unit length of crack in the core is high. Such energy absorption per unit length of crack is approximately equal to $$\frac{(K^2 m)}{E}$$

where (m) is the distance through the which the energy travels. In this case (m) in the thickness of the core 18. The total energy absorption per unit length of developed crack $$\frac{(K^2 m)}{E}$$

is enhanced by the cracking, pulverization and disintegration of the core since this introduces a very large crack length. Also, in addition to absorbing energy, the non-homogeneity of the core and the included grit particles acts to reflect and disperse the shock wave.

In addition to the high energy absorption from crack propagation, a large amount of energy is dissipated by shearing and strain energy to failure of the materials and by kinetic energy imparted to the small broken pieces of debris.

A backing 24 sandwiches the core between the ceramic facing 20 and the backing and is provided by a layer of elastomeric material, preferably a tough but elastic rubber. In a preferred embodiment EPDM rubber, or 12% carbon rubber which may be synthetic nitrille rubber, may be used. The backing is flexible and facilitates cracking and pulverization as the shock wave causes strain in the backing 24. In other words, the elastic backing 24 acts as a shock absorber and deflects the shock wave while holding the tile in place and providing time until the disintegration mechanism is completed. It also distributes the energy of the compression shock wave which returns as a tensile wave through the core from the backing. Any rupturing of the elastic backing also absorbs energy and in addition serves to catch small particles of debris.

It has also been found desirable to use composite sheets of fiber and polymeric matrix material. The fibers may be strands of carbon or glass. The carbon fibers have a much higher strength than glass. Two sheets are preferably used in which the fibers are disposed in transverse directions and preferably perpendicular to each other. In a preferred embodiment the thickness of the composite sheet layer is between 30 and 60 mils. Prior to final curing of the polymer matrix, the composite sheets 26 and 28 are known as "prepreg" material and are available commercially. It has been found that type 30346 manufactured by ICI FIBERITE, Winona, Minn. is suitable. However, sheets of final cured prepreg laminates may also be used and depending upon the final assembly process may be preferred.

The tile may be fabricated individually or stacked with other tiles and assembled to form a module. If assembled individually, adhesive such as room temperature vulcanizing (RTV) silicone may be used between the ceramic facing and the surface 22 and rubber cement may be used between the bottom sheet 28 and the upper surface of the elastic layer 24. Then the tile composite assembly is allowed to cure for about one-half hour at 300° F. with approximately a three pound clamping force. This cures the prepreg sheets and laminates them together and to the core 18.

At least one and preferably two layers 26 and 28 (total thickness of between 30 and 60 mils) of composite material are used. They enhance the flexural strength of the elastic layer 24 providing additional energy absorption as they splinter or pull apart while at the same time they do not eliminate the desired elastic compliance and shock absorbing functions of the elastomer 24. They also assist the elastic backing in deflecting the shock wave. In effect, the sheets interpose a short (picosecond) delay which facilitates the distribution of energy to the elastomeric backing 24 and back into the core layer 18.

It may be desirable to secure the individual elements by encasing them in a tube of plastic which is then shrink wrapped around the core. This provides a coating of elastomeric polymer around the facing which retards back scatter when the facing breaks up or due to the reflected shock wave. Plastic tape wrapped around the tile may also be used. A coating of elastomeric polymer on the outside of the facing 10 may alternatively be used.

Figure 2A:
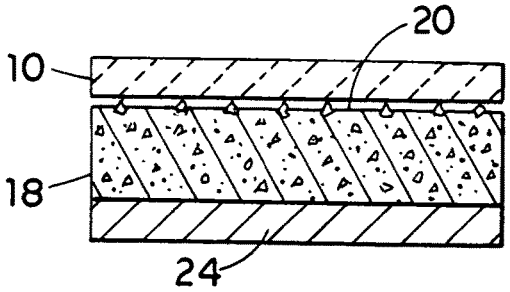
FIGS. 2A, B and C are views similar to FIG. 1 showing tiles in accordance with other embodiments of the invention.

It may be desirable that means be provided for causing a small air gap (suitably from 10 to 30 mills) in thickness between the ceramic facing 20 and the core 18 as shown in FIG. 2A. FIG. 2A omits the composite sheets 26 and 28. The means for providing the gap may be protuberances on the surface 22 of the core 18. The gap allows the facing to move laterally with respect to the core and serves to chop any plasma jet due to the projectile or the shock wave, and even, to divert the projectile itself, thereby absorbing energy and slowing the projectile.

Figure 2B:
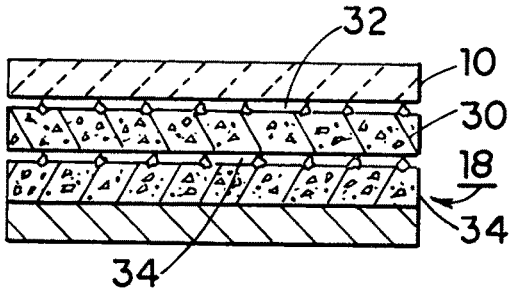
Figure 2C:
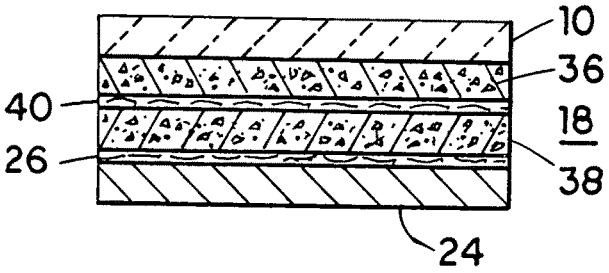

As shown in FIG. 2B, the core 18 may be made up of two layers 30 and 31 each having projections to provide two air gaps 32 and 34. This further enhances the chopping effect. Air gaps also represent changes of acoustic impedance which further helps control the progress of the shock wave. Instead of the air space, the core 18 may be made up of two layers of non-homogeneous core with grit particles 36 and 38 which are separated by a composite sheet 40 as shown in FIG. 2C. More than two core layers may be used depending upon the threat. Plural layers are desirable when a long (needle-like) projectile is the expected threat.

Figure 3:
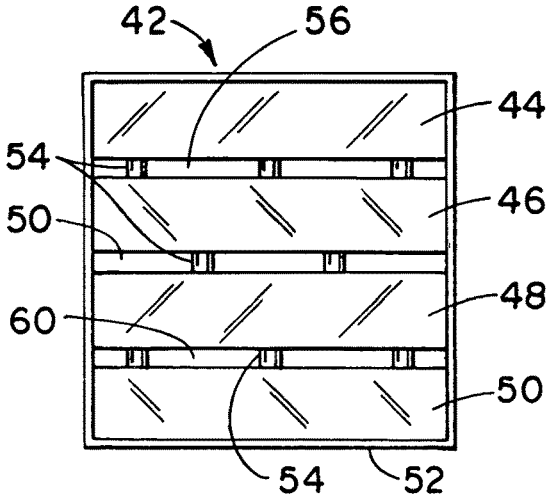
FIG. 3 is a front view of a module made up of four tiles; the module being a cube.

Referring to FIG. 3, there is shown a cubic module 42 made up of four tiles 44, 46, 48, and 50. These modules are assembled by surrounding them with a shrink wrap tube 52 of plastic or by tape. As noted above, the tube or tape may be dispensed with if the module is laminated together. To this end, rather than placing individual tiles in an oven under clamping pressure to cure the prepreg sheets 26 and 28, successive layers of elastomeric backing 24, composite prepreg sheets 26 and 28, polymeric/ceramic core 18 and ceramic facing 20 may be stacked so as to provide four distinct tile layers. Rubber cement between the elastomeric backing and the last prepreg sheet and RTV silicone between the surface 22 and, the ceramic facing 10 may be used. Then the entire assembly is clamped and while clamped and held, heated in an oven (at 300° F.) for a sufficient period (e.g. one hour) to cure the prepreg sheets. The module will then be an integrated assembly of tiles.

Spacers, such as plastic disks 54 may be located between the individual tiles 44, 46, 48 and 50 to provide gaps 56, 58 and 60. These gaps afford air spaces which enhance energy absorption capability. Energy absorption may be further enhanced by filling the gaps with rheopectic material. Such material has the characteristic that its viscosity increases with shear rate. In other words, it is originally putty-like in consistency, but becomes stiffer when a projectile passes through it. Suitable rheopectic materials may be selected depending upon the threat (the velocity of the expected projectiles and their shape). A discussions of such materials may be found in the following text: A. H. Skelland, "Non-Newtonian Flow and Heat Transfer", published by John H. Wiley (1967). See, for example, page 13. Other rheopectic materials are discussed in in U.S. Pat. Nos. 3,952,365 and 4,497,923. Of course, when rheopectic material is confined in the gaps, the entire module 42 is desirably enclosed, for example, in shrink wrap material 52.

Figure 4:
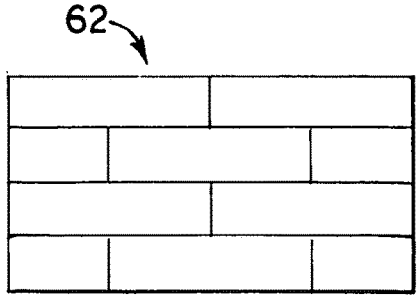
FIG. 4 is a front view of a module made up of tiles which are rectangular paraboloids and which are stacked in offset relationship much as in a mason wall.
Figure 7:
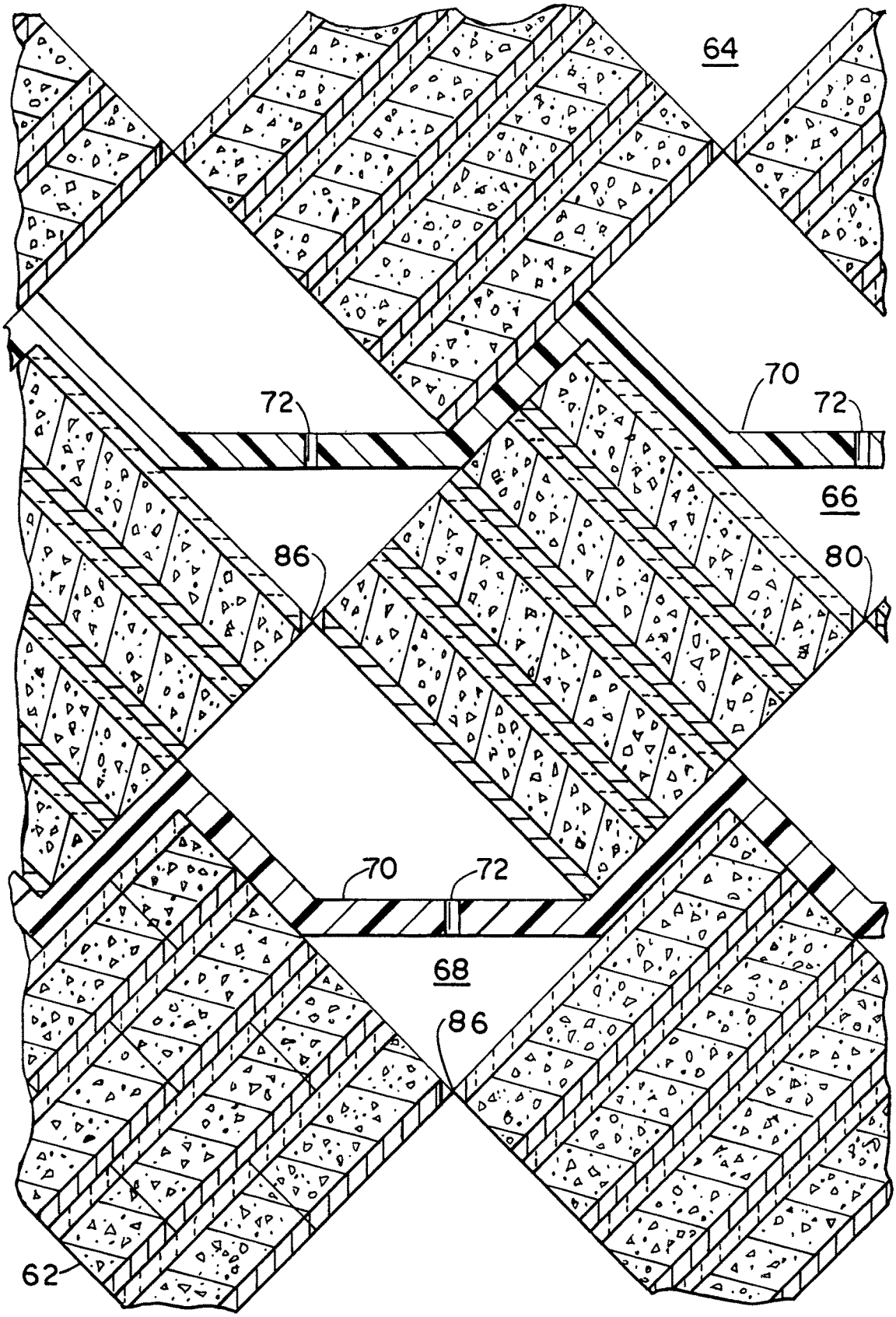
FIG. 7 is a fragmentary sectional top view similar to FIG. 5 showing portions of three rows of tiles of a panel which embodies the invention, but in greater detail than shown in FIG. 5.

Referring to FIG. 4, there is shown another module 62 which is made up of tiles which are rectangular on their top and bottom surfaces, for example 1½ inches long by ¾ inch wide and are assembled together in offset relationship, much like a brick wall. This arrangement further enhances spreading of the impact load from a point on the front tile to the entire area of the tiles in subsequent tile layers of a module. Such a tile module 62 is also shown in FIG. 7.

It will be noted that in each tile the acoustic impedance decreases in the direction in which the incoming object travels. Such a decrease causes an interface which tends to reduce the transmission of acoustic (shock) waves and enhances their reflection. Thus the shock waves, as well as the projectiles, are stopped and disintegration which absorbs energy in the cores 18 of each tile is enhanced.

It should be appreciated that there are many factors which are responsible for the effectiveness of the armor structure provided by the invention. Nothing herein should be construed to limit the invention to any particular mechanism or mode of operation.

Figure 5:
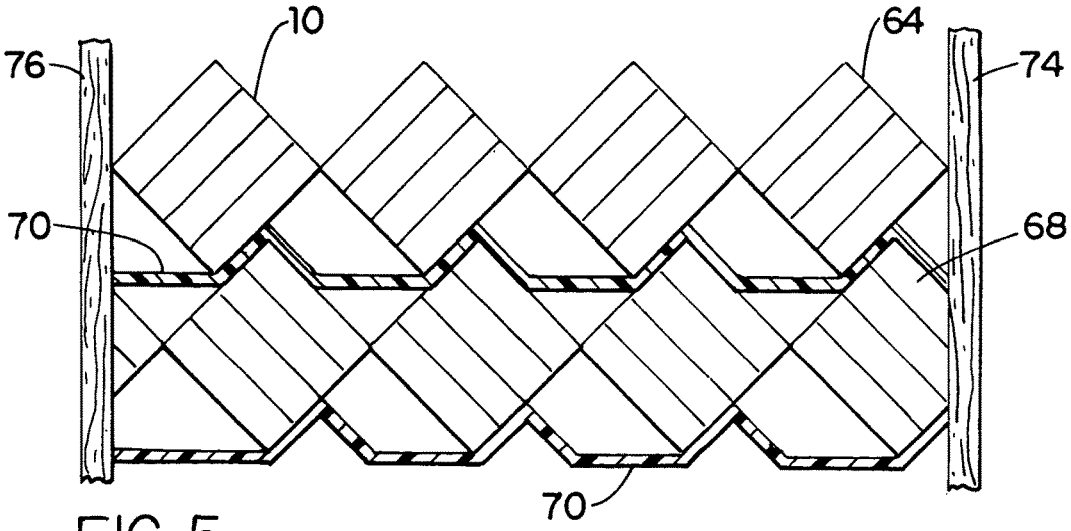
FIG. 5 is a fragmentary top view showing a panel made up of two rows of cube shape tiles.
Figure 6:
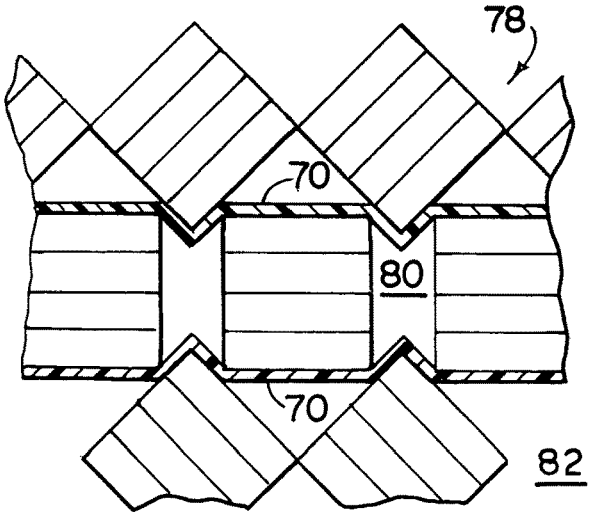
FIG. 6 is a fragmentary top view showing another arrangement of cube tiles which provides a panel in accordance with another embodiment of the invention.

Referring to FIGS. 5 and 6, there is shown a panel made up of rows 64, 66 and 68 of modules. These modules may be of the type shown and described in connection with FIG. 3 or with FIG. 4. The modules are supported on the catcher shield sheets, for example, ⅛ inch thick sheets which are preferably UHMPE (ultra high modulous polyethylene). One such material sold under the trade name Spectra by Allied Chemical Company of Petersburg, Va. is suitable for use as the support sheets 70. These sheets may be vented between the modules as shown at 72 in FIG. 7. While two rows 64 and 68 are shown in FIG. 5 and three in FIG. 7, it will be appreciated that one row, or as many as needed depending upon weight constraints and the threat, may be used. The rows are supported in a structural frame which may be of wood or other suitable material. Two side members 74 and 76 of this frame are shown in FIG. 5. In the preferred embodiment, the frames are sectionalized within a large panel wall and limited in size for ease in removal and replacement for damage repair and the section size is defined for instance by handling weight constraints. The individual frames can be attached to and supported by a wide variety of standard structural support columns not shown. There may be, for example, 4 or more modules in a row. In some instances, only a single tile may be provided instead of a module in each row. Two or three tiles may also be provided instead of cubic modules that employed four 3"×3"×¾" tiles per module in the present embodiment. In successive rows, the surface of the tiles facing the incoming threat are inclined obliquely (e.g. 45°) to the direction of the incoming objects which constitute the threat. In FIGS. 5 and 7, the tiles in successive rows are disposed perpendicularly to each other with the edges of the tile in the second row 66 facing the surfaces of the tile in the first row.

In accordance with another arrangement as shown in FIG. 6, there may be three rows of modules 78, 80 and 82. The modules in the first and third rows are oblique to the direction of some incoming objects from one direction while the modules in the second row would be perpendicular to the direction of these incoming objects but in turn would be oblique to incoming objects from another direction. In the embodiment shown in FIG. 5 as well as the embodiment shown in FIG. 6, there are different angles and obliqueness of the surfaces of the modules so as to provide assurance that some modules will be disposed obliquely to all incoming objects.

It will be appreciated that several larger panels may be provided each with its own module frame sections and used to construct protective walls or even used alone as the walls of revetments or temporary structures.

As shown more particularly in FIG. 7, the edges of the adjacent modules in each row are in contact. Vent groves 86 are provided. These vent groves and the vent holes in the support sheet 70 allow for the propagation of any compressed air through the panel.

The modules are adhesive mounted to the catcher shield support sheets 70 which as formerly mentioned also serve to restrain the tile disintegration debris. When a high velocity object hits a module, one or more tiles will disintegrate. The replacement of the module is an easy task since the module is confined to a small frame which is readily removeable from a panel and the damaged module merely has to be removed after which the frame is returned into the panel. Individual module rows mounted to the support sheets 70 are integral within the frame and can be pulled forward out of the frame to gain access to all rows.

The modules and all other materials can be monolithic, ceramic or plastic materials which are not subject to rusting and are relatively insensitive to temperature. Any expansion merely moves the modules about which does not render the armor structure any less effective, since the tiles and modules are intentionally supported to slide and move about under impact from the incoming objects and to do so as an enhancement in the process of absorbing energy and preventing the penetration of the object or any spall into the protected area.

From the foregoing description, it will be apparent that there has been provided improved armor structures which are both effective and light in weight. The area density of this effective ballistic protective structure is far less than steel. For example, an individual 3"×3"×¾" thick tile as described in connection with FIG. 1 weighs about 0.54 pound. Three inch cubic modules (i.e., 4 tile layers per module) of such tile that are oriented at 45° to the direction of the incoming objects as shown in FIGS. 5, 6 and 7 have a projected frontal area density of about 24.45 pounds per square foot for a one row configuration. A three row 45° oriented arrangement of three inch cubical modules then has a projected frontal area density of only 73.35 pounds per square foot which is equivalent to 1.76 inches of steel plate facing at 0° to the threat direction. Moreover, the effectiveness of ballistic protection of the armor structure provided by the invention is three to four times that of the steel plate. Thus, a 3 row configuration as shown in FIGS. 6 and 7 has great threat stopping potential and even a one row arrangement has the potential of handling a vast majority of expected projectile threats. Other advantages, as well as variations of modifications of the herein described armor structure and the methods of fabricating and assembling same, within the scope of the invention, will undoubtedly suggest themselves to those skilled in the art. Accordingly, the foregoing description should be taken as illustrative and not in a limiting sense.

The invention claimed is:

1. Armor structure which protects against incoming objects and which is a tile comprising a brittle first body of non-homogeneous material which is frangible upon impact, said first bocy having a surface facing said incoming objects, and a second body of impact frangible material which is stiffer than said first body and is disposed upon said surface for distributing impacts from said objects over said surface, said first and second body materials cooperating to enable said first body to absorb, divert and commutate the energy and shock waves due to the incoming objects by disintegration in said first body and fracturing in said second body.

2. Armor structure according to claim 1 wherein said first body is provided by particulate material distributed in a matrix of plastic material.

3. The armor structure according to claim 2 wherein said second body is provided by hard, stiff material such as ceramic.

4. The armor structure according to claim 3 wherein said second body consists of silicon carbide.

5. Armor structure according to claim 2 wherein the particulate material of said first body is granules of material having a modulus of elasticity that is a plurality of orders of magnitude higher than the modulus of elasticity of said plastic providing said matrix.

6. The armor structure according to claim 5 wherein said particulate material is selected from the ceramic groups including silicon carbide and quartz.

7. The armor structure according to claim 6 wherein said plastic is a polymer.

8. The armor structure according to claim 7 wherein said polymer is epoxy.

9. Armor structure which protects against incoming objects and which comprises a first body of non-homogeneous material which is frangible upon impact, said first body having a surface facing said incoming objects, and a second body of impact frangible material which is stiffer than said first body and is disposed upon said surface for distributing impacts from said objects over said surface whereby to enable said first body to absorb, divert and commutate the energy and shock waves due to the incoming objects by disintegration in said first body and fracturing in said second body, said first body being provided by particulate material distributed in a matrix of plastic material, and the particulate material of said first body being granules of material having a modulus of elasticity that is a plurality of orders of magnitude higher than the modulus of elasticity of said plastic providing said matrix, wherein said particulate material is selected from the ceramic groups including silicon carbide and quartz, said plastic is an epoxy polymer, said particulate material is mixed sufficiently with said epoxy while said epoxy is fluid to provide a mixture in which particles of said particulate material are distributed, and said first body is formed by molding and curing for a time sufficient to provide impact frangible and disintegratable characteristics in the material of said first body.

10. The armor structure according to claim 1 wherein said first body has a modulus of elasticity of about 10,000 to 20,000 psi and a toughness coefficient of about 20,000 PSI $(\text{inches})^{1/2}$ at room temperature.

11. Armor structure which protects against incoming objects and which comprises a first body of non-homogeneous material which is frangible upon impact, said first body having a surface facing said incoming objects, and a second body of impact frangible material which is stiffer than said first body and is disposed upon said surface for distributing impacts from said objects over said surface whereby to enable said first body to absorb, divert and commutate the energy and shock waves due to the incoming objects by disintegration in said first body and fracturing in said second body, wherein said first and second bodies are successive plates which define a tile, and said structure comprises a module containing a plurality of said tiles disposed in stacked relationship with the plates providing said first body alternating with the plates providing said second body.

12. The armor structure according to claim 11 wherein a plurality of said modules are disposed in a row to define a panel.

13. The armor structure according to claim 12 further comprising a sheet of elastomeric material supporting said row on one side thereof.

14. The armor structure according to claim 12 wherein said panel is provided by a plurality of rows of said modules, said modules in each of said rows being disposed at a different angle to the direction of said incoming objects.

15. The armor structure according to claim 14 wherein sheets of elastomeric material are disposed between adjacent ones of said rows in supporting relationship with said rows.

16. The armor structure according to claim 15 wherein said modules in each of said rows have contacts with each other, vent grooves in said modules through said contacts, and vent holes in said supporting sheets.

17. The armor structure according to claim 12 wherein at least one of said rows facing said incoming object has said plates of said module disposed at an oblique angle to the direction of said incoming objects.

18. The armor structure according to claim 14 or 17 wherein said plates are rectilinear and have sides and edges, a first of the said plurality of rows facing said incoming object and others of said plurality of rows being disposed behind said first row, at least the second of said plurality of rows being disposed so that one of the edges of said plates of said second row faces the sides of the plates in said first row.

19. The armor structure according to claim 18 wherein said panel includes at least a third row between said first and second rows having said sides of the plates thereof perpendicular to the direction of said incoming objects.

20. The armor structure according to claim 12 wherein said tiles are rectangular and have sides and edges along the width and the length thereof, said stacks having a plurality of layers, alternate ones of said layers having the sides of said tiles along the length thereof and the sides of said tiles along the width thereof disposed adjacent to each other and perpendicular to each other.

21. The armor structure according to claim 12 further comprising a layer of ductile material around said module.

22. The armor structure according to claim 21 wherein said layer is provided by a tube of plastic shrink wrapped around said module.

23. The armor structure according to claim 1 further comprising means providing a gap between said surface of said first body and said second body.

24. The armor structure according to claim 23, wherein said gap is of the order of 10 to 30 mils.

25. The armor structure according to claim 23 wherein said gap or gaps are of the order of 10 to 30 mils.

26. The armor structure according to claim 1 wherein said first body and said second body are first and second layers respectively, said first layer being thicker than said second layer.

27. The armor structure according to claim 26 wherein said first layer is about four times thicker than said second layer.

28. The armor structure according to claim 1 wherein said second and first bodies are second and first layers, said second layer and first layer being disposed successively in the order stated in the direction of said incoming objects such that said first layer is in back of said second layer.

29. The armor structure according to claim 28 wherein at least one layer of elastomeric material is disposed in back of said first layer and provides a third layer of said tile.

30. Armor structure which protects against incoming objects and which comprises a first body of non-homogeneous material which is frangible upon impact, said first body having a surface facing said incoming objects, and a second body of impact frangible material which is stiffer than said first body and is disposed upon said surface for distributing impacts from said objects over said surface whereby to enable said first body to absorb, divert and commutate the energy and shock waves due to the incoming objects by disintegration in said first body and fracturing in said second body, said first body being provided by particulate material distributed in a matrix of plastic material, the particulate material of said first body being granules of material having a modulus of elasticity that is a plurality of orders of magnitude higher than the modulus of elasticity of said plastic providing said matrix, and said first material having a greater percentage by weight of said particulate material than of said plastic material.

31. The armor structure according to claim 30 wherein said percentage by weight is about 60-90%.

32. Armor structure which protects against incoming objects and which comprises a first body of non-homogeneous material which is frangible upon impact, said first body having a surface facing said incoming objects, and a second body of impact frangible material which is stiffer than said first body and is disposed upon said surface for distributing impacts from said objects over said surface whereby to enable said first body to absorb, divert and commutate the energy and shock waves due to the incoming objects by disintegration in said first body and fracturing in said second body, said first body being provided by a plurality of separate layers disposed adjacent to each other.

33. The armor structure according to claim 32, said surface being provided on the one of said plurality of first body layers nearest to said second body, and said structure further comprising means providing gaps between said second body and said surface which is provided the one of said plurality of first bodies adjacent thereto, and means providing a gap between separate bodies which provide said first body.

34. Armor structure which protects against incoming objects and which comprises a first body of non-homogeneous material which is frangible upon impact, said first body having a surface facing said incoming objects, a second body of impact frangible material which is stiffer than said first body and is disposed upon said surface for distributing impacts from said objects over said surface whereby to enable said first body to absorb, divert and commutate the energy and shock waves due to the incoming objects by disintegration in said first body and fracturing in said second body, and means providing a gap between said surface of said first body and said second body, said gap being of the order of 10 to 30 mils.

35. Armor structure which protects against incoming objects and which comprises a first body of non-homogeneous material which is frangible upon impact, said first body having a surface facing said incoming objects, a second body of impact frangible material which is stiffer than said first body and is disposed upon said surface for distributing impacts from said objects over said surface whereby to enable said first body to absorb, divert and commutate the energy and shock waves due to the incoming objects by disintegration in said first body and fracturing in said second body, said first and second bodies being successive plates which define a tile, said structure comprising a module containing a plurality of said tiles disposed in stacked relationship with the plates providing said first body alternating with the plates providing said second body, and means providing gaps between said tiles in said module.

36. The armor structure according to claim 35 wherein said gaps contain rheopectic material.

37. Armor structure which protects against incoming objects and which comprises a first body of non-homogeneous material which is frangible upon impact, said first body having a surface facing said incoming objects, a second body of impact frangible material which is stiffer than said first body and is disposed upon said surface for distributing impacts from said objects over said surface whereby to enable said first body to absorb, divert and commutate the energy and shock waves due to the incoming objects by disintegration in said first body and fracturing in said second body, said first and second bodies being successive plates which define a tile, said structure comprising a module containing a plurality of said tiles disposed in stacked relationship with the plates providing said first body alternating with the plates providing said second body, and ductile adhesive material disposed between adjacent ones of said tiles connecting them in laminated relationship.

38. Armor structure which protects against incoming objects and which comprises a first body of non-homogeneous material which is frangible upon impact, said first body having a surface facing said incoming objects, and a second body of impact frangible material which is stiffer than said first body and is disposed upon said surface for distributing impacts from said objects over said surface whereby to enable said first body to absorb, divert and commutate the energy and shock waves due to the incoming objects by disintegration in said first body and fracturing in said second body, said first and second bodies being successive plates which define a tile, said structure comprising a module containing a plurality of said tiles disposed in stacked relationship with the plates providing said first body alternating with the plates providing said second body, said module being a cube.

39. The armor structure according to claim 38 wherein said tiles are rectangular and identical to each other in shape and are assembled into a cube.

40. Armor structure which protects against incoming objects and which comprises a first body of non-homogeneous material which is frangible upon impact, said first body having a surface facing said incoming objects, and a second body of impact frangible material which is stiffer than said first body and is disposed upon said surface for distributing impacts from said objects over said surface whereby to enable said first body to absorb, divert and commutate the energy and shock waves due to the incoming objects by disintegration in said first body and fracturing in said second body, said second and first bodies are second and first layers, said second layer and first layer being disposed successively in the order stated in the direction of said incoming objects such that said first layer is in back of said second layer, at least one layer of elastomeric material being disposed in back of said first layer and providing a third layer of said structure, said third layer being a tough, flexible rubber.

41. The armor structure according to claim 40 wherein at least one composite sheet of fibers and polymeric matrix material is disposed between said first and third layers.

42. The armor structure according to claim 41 wherein said first layer consists of particulate material distributed in a matrix of polymeric material and said second layer is ceramic material.

43. The armor structure according to claim 41 wherein said first layer consists of particulate material distributed in a matrix of polymeric material and said second layer is ceramic material.

44. The armor structure according to claim 41 wherein said sheet is laminated to said first and third layers.

45. The armor structure according to claim 40 wherein a plurality of composite sheets of fiber and polymeric matrix material having strands of fiber in each sheet disposed transversely to each other are disposed between said first and third layers.

46. The armor structure according to claim 45 wherein said fiber strands are selected from the group consisting of glass and carbon fibers.

47. Armor structure which protects against incoming objects and which comprises a first body of non-homogeneous material which is frangible upon impact, said first body having a surface facing said incoming objects, and a second body of impact frangible material which is stiffer than said first body and is disposed upon said surface for distributing impacts from said objects over said surface whereby to enable said first body to absorb, divert and commutate the energy and shock waves due to the incoming objects by disintegration in said first body and fracturing in said second body, said second and first bodies are second and first layers, said second layer and first layer being disposed successively in the order stated in the direction of said incoming objects such that said first layer is in back of said second layer, at least one layer of elastomeric material being disposed in back of said first layer and providing a third layer of said structure, said first layer consisting of particulate material distributed in a matrix of polymeric material and said second layer being ceramic material.

48. The armor structure according to claim 47 wherein the material of said second layer is selected from the ceramic group including silicon carbide, silicon nitride, boron carbide, boron nitride and glass.

49. The armor structure according to claim 47 wherein said first layer is at least twice the thickness of said second and third layers.

50. The armor structure according to claim 47 wherein said particulate material is porous.

51. The armor structure according to claim 47 wherein said particulate material is about from 20 to 24 grit in size (flakes or cubes about 30 mils along their largest sides).

52. A composite tile armor structure especially suitable for use in providing protection against incoming, lightweight ballistic objects, said tile comprising a first body of non-homogeneous, impact frangible core material made up of grit particles distributed throughout a brittle matrix, said first body having a surface for presentation toward said incoming objects, and a second body of impact frangible facing material disposed adjacent to and in contact with said surface; said facing material having a stiffness greater than the stiffness of said core material sufficient to cause impact forces from said objects impinging on said second body to be distributed over said surface of said first body by fracturing in said second body; and said grit particles defining discontinuity sites for development of stress risers in said first body for enabling said distributed forces to be further dissipated by scattering of particles of said core material through disintegration of said first body.

* * * * *